US005620725A

United States Patent [19]

Jamieson et al.

[11] Patent Number: 5,620,725

[45] Date of Patent: Apr. 15, 1997

[54] CARBONATED BEVERAGE CONTAINER AND METHODS FOR FILLING SAME

[75] Inventors: James G. Jamieson, Mauldon; David R. Maule, Bedford; Mark P. Radford, Silsoe; Ernest J. Cameron-Price, Stirchely; Edward R. Costello, Coventry; Peter F. Kershaw, Catshill, all of England

[73] Assignees: Whitbread PLC., London, England; Heineken Technical Services B.V., Amsterdam, Netherlands

[21] Appl. No.: 859,299

[22] Filed: Jul. 22, 1993

[30] Foreign Application Priority Data

| | | | |
|---|---|---|---|
| Nov. 22, 1989 | [GB] | United Kingdom | 8926374 |
| Dec. 21, 1989 | [GB] | United Kingdom | 8928892 |
| Jan. 12, 1990 | [GB] | United Kingdom | 9000743 |
| Mar. 2, 1990 | [GB] | United Kingdom | 9004731 |

[51] Int. Cl.[6] ..... B65B 31/00; B65B 17/00; B65B 25/00

[52] U.S. Cl. ..... 426/112; 426/115; 426/124; 426/131; 426/132; 426/397; 426/401; 206/222; 220/501; 220/553; 53/420; 53/432

[58] Field of Search ..... 426/106, 112, 426/115, 124, 131, 397, 398, 394, 474, 477, 401; 53/420, 432, 433, 471, 474; 206/220; 220/501, 553

[56] References Cited

U.S. PATENT DOCUMENTS

| | | | |
|---|---|---|---|
| 4,518,082 | 5/1985 | Ye | 206/217 |
| 4,524,078 | 6/1985 | Bardsley et al. | 426/112 |

FOREIGN PATENT DOCUMENTS

| | | |
|---|---|---|
| 1266351 | 3/1972 | United Kingdom . |
| 1331425 | 9/1973 | United Kingdom . |

*Primary Examiner*—Steven Weinstein
*Assistant Examiner*—Curtis E. Sherrer
*Attorney, Agent, or Firm*—Sughrue, Mion, Zinn, Macpeak & Seas

[57] ABSTRACT

When dispensing carbonated beverages, particularly beers and especially draught stout, it is desirable to obtain a close-knit creamy head. To achieve this a container (1) includes a separate closed hollow insert (5) containing substantially no oxidising gas and means (6) responsive to opening of the container (1) to provide communication between the inside of the insert (5) and beverage (7) contained in the body of the container (1) upon opening it to jet gas from the insert (5) into the beverage (7). The means (6) preferably has the form of a pressure responsive valve. The insert (5) may be arranged so that its internal pressure is increased after the container (1) is sealed or the means (6) may have a different relief pressure when initially inserted into the container (1) from that upon opening the container (1).

14 Claims, 12 Drawing Sheets

Fig. 11.
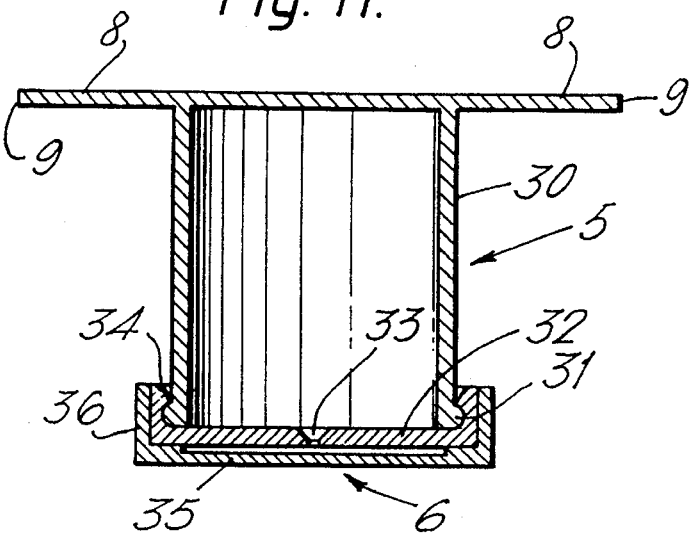
Fig. 12.
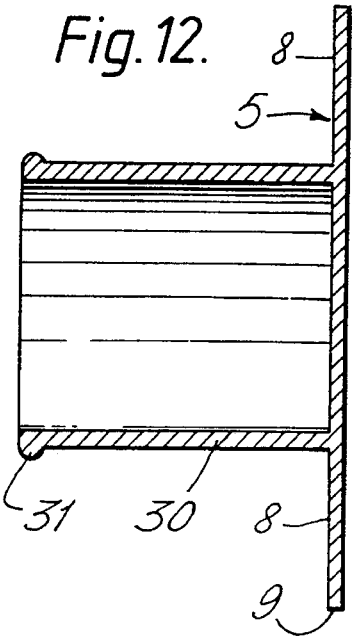
Fig. 14.
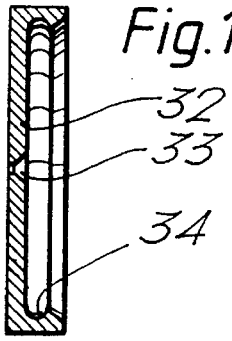
Fig. 13.
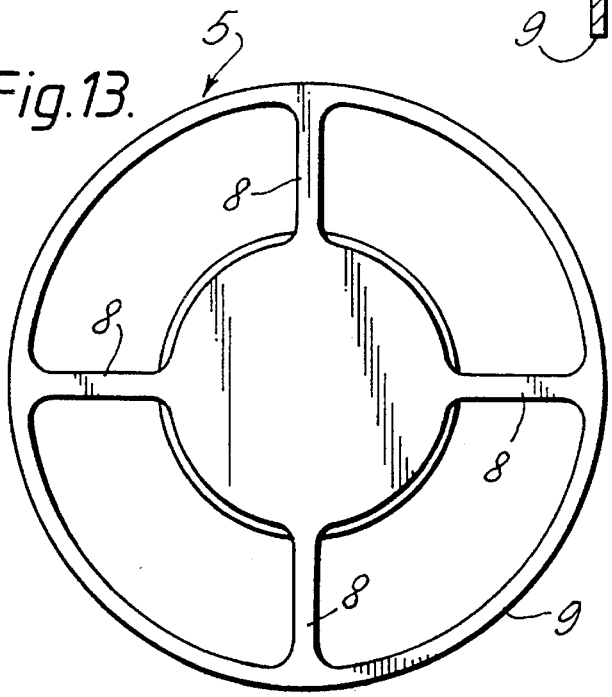
Fig. 15.
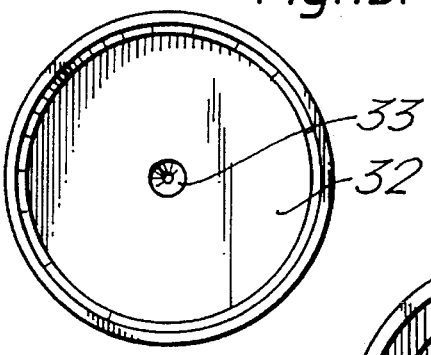
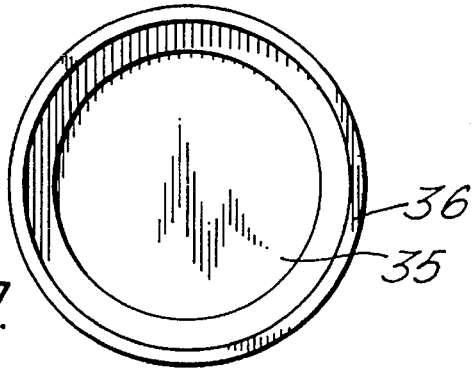
Fig. 17.
Fig. 16.
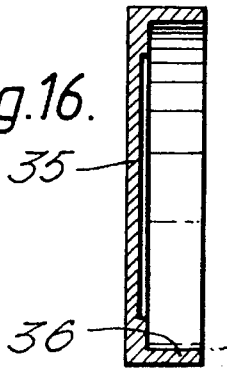

CARBONATED BEVERAGE CONTAINER AND METHODS FOR FILLING SAME

When dispensing carbonated beverages, particularly beers and especially draught stout, it is desirable to obtain a close-knit creamy head. This contributes to a creamy taste and adds considerably to the customer appeal. Traditionally such heads are only obtained when dispensing such beverages from draught. Another factor that considerably enhances the appeal is the way in which, when dispensing beverages, especially beers, from draught, small bubbles are intimately mixed with the body of the beverage as it is dispensed and then, after dispensing is completed they gradually separate out to form this close-knit creamy head.

The formation of such small bubbles liberated throughout the body of the beverage during dispensing can be encouraged by causing shear of the liquid with resulting local pressure changes which causes release of small bubbles of controlled and uniform size. Over the years many proposals have been made to increase and control the liberation of such small bubbles and the generation of heads on beverages. Our own earlier specification GB-A-1378692 describes the use of an ultrasonic transducer to subject the beverage to shear immediately before it is dispensed into a drinking vessel and describes the way that by subjecting the initially dispensed portion of beverage to ultrasonics the small bubbles released from this initial portion then gradually float up through the remainder of the beverage forming nucleation sites and triggering the generation of further small bubbles of controlled size.

There have been many other proposals such as those described in GB-A-1280240, GB-A-1588624 and GB-A-2200854 to encourage the formation of the required close-knit creamy head on beers and other carbonated beverages. However, most of these proposals are concerned with the formation of a head as a beer is dispensed from draught.

GB-A-1266351 describes a system for producing a draught type head when dispensing beer, or other carbonated beverage, from a container such as a can or bottle. In the arrangement described in this specification, the container includes an inner secondary chamber which is charged with gas under pressure either as part of the filling process in which the container is filled with beverage or by pre-charging the inner secondary chamber with gas under pressure and sealing it with a soluble plug made from a material such as gelatine which, dissolves shortly after filling. The secondary chamber includes a small orifice and the overall arrangement is such that, upon opening the container and so reducing the pressure in the main body of the container, gas from the secondary chamber is jetted via the orifice into the beer in the main body of the container so causing shear and liberating the required small bubbles which in turn act as nucleation sites to trigger release of similar bubbles throughout the entire contents in the can or other container. The arrangements described in this patent specification are somewhat complex mainly requiring the use of a separate charging step to pressurize the secondary chamber and a specially designed divided can with the result that this technique has not been adopted commercially.

GB-A-2183592 describes a different technique which has recently achieved success in the market place. In this system a container of a carbonated beverage includes a separate hollow insert with an orifice in its side wall. As part of the container filling process beer is deliberately introduced into the inside of the hollow insert through the orifice and the pressures of the inside of the insert and the main body of the container are in equilibrium. Upon opening the container the beverage from inside the insert is jetted out through the orifice into the beverage in the body of the container and this jet acts to shear liquid in the container with the result that a number of small bubbles are liberated which, in turn, act as nucleation sites to generate a number of small bubbles throughout the entire contents of the container. When dispensing a beverage from such a container into a drinking vessel the liberation of small bubbles throughout the entire volume of the beverage as it is dispensed gives a similar appearance to dispensing the same beverage from draught. This system has many disadvantages. It is essential to remove oxygen from inside the hollow insert before filling the container with beverage. The presence of oxygen inside the container leads to the beverage being oxidized with a resulting impairment of flavour and risk of microbial growth leading to, for example, acetification of the resulting beverage when it contains alcohol. Thus, there is a general requirement to displace substantially all of the oxygen from a container, and its secondary chamber, when this is used, before the container is sealed. When the secondary chamber has the form of a hollow insert with only a small orifice in its wall and this insert is filled with air it is difficult to displace all of the air during the filling and sealing of such a container.

As a way of overcoming this problem GB-A-2183592 describes manufacturing such a secondary chamber by a blow molding technique using an inert gas to form the secondary chamber and then only forming the orifice as the secondary chamber is placed into the container, for example by irradiation with the laser beam. However, in practice, this is not the way that such containers are filled. In practice, the secondary chamber is injection molded in two halves, which are subsequently welded together. As it is formed, the normal atmospheric gases fill the secondary chamber. Such a secondary chamber is then inserted into an empty container and the whole is subjected to a reduced pressure, filled with a non-oxidizing gas such as carbon dioxide, nitrogen, or a mixture of these, and evacuated again to flush substantially all of the oxygen from both the inside of the container and the inside of the secondary chamber before the container is again filled with a non-oxidizing gas and only after that filled with beverage. In this way the amount of oxygen remaining in the sealed container is reduced to an acceptable level but these additional evacuation and flushing steps add a considerable delay and difficulty to the container filling stage with the result that the speed of filling is reduced to about 25 per cent of that of an equivalent system in which a secondary chamber is not included in the container. Also, since they require the use of a special, non-conventional filling machine this also imposes a considerable capital cost burden.

According to this invention a sealed container includes a separate closed hollow insert containing substantially no oxidizing gas and means responsive to opening of the container to provide communication between the inside of the insert and beverage contained in the body of the container upon opening of the container.

Upon opening the sealed container the insert contains gas at a super atmospheric pressure, so that, on opening the container, the means opens to inject gas from the hollow insert into the beverage in the container to cause shearing of the beverage in the container and liberation of small bubbles throughout the contents of the container.

The means may have the form of a burst disk which, upon subjecting the burst disk to the pressure differential between that subsisting in the inside of the insert and atmospheric pressure subsisting in the container after it is opened, bursts the burst disk to provide an aperture through which the gas is injected into the beverage in the container.

The means may alternatively have the form of a manually openable valve or puncturing device connected to the container closure so that, upon opening the container the opening operation also opens the valve or punctures the insert to release the non-oxidizing gas from the insert into the beverage in the container. Alternatively, the means has the form of a pressure responsive valve which, when exposed to the pressure difference subsisting between the gas inside the insert and the atmospheric pressure subsisting in the container after opening, opens to jet gas into the beverage in the body of the container.

One form of the valve consists of a bore terminating in a restricted orifice and a plug on the outside of the insert which fits inside the bore and which, when subjected to the pressure differential created on opening the container is blown out of the bore to provide jetting of the gas into the beverage via the restricted orifice. In this case preferably the plug is a captive plug molded integrally with the material surrounding the bore and orifice. Another type of valve includes a cap which can be blown off or slide axially to expose at least one orifice in the wall of the insert or in the cap. This type of valve is arranged so that, the cap is subjected to the pressure difference subsisting between the inside and outside of the insert and this acts to open the cap to expose the at least one orifice and thereby allow gas to be vented via the at least one orifice into the beverage in the container.

In a further, preferred arrangement the valve may have the form of a pressure responsive member which is exposed to any pressure difference between the inside of the insert and the inside of the container and which moves or distorts to open an aperture to allow escape of gas from inside the insert into the beverage in the container. One form of this valve comprises a captive resilient bung inserted through an aperture in the wall of the insert which, when subjected to a sufficient pressure differential, flexes to allow gas to be vented from inside the insert through the opening into the beverage in the body of the container. Another form of this type of valve comprises a seating surrounding the inside of an orifice and a valve closure member which seats against and forms a seal with the seating. Preferably the insert includes two opposed faces with the orifice and seating formed on one face and the valve closure member attached to the inside of the other face and extending to the seating on the inside of the one face. By forming the insert from slightly resilient material such as a plastics material at least one of the opposed faces flexes outwards as a result of pressure differences between the inside and outside of the insert after the container is opened. Such flexing of the face causes relative movement between the seating and the valve closure member to unseat the closure member to allow gas from inside the insert to pass between the seating and valve closure and to be emitted through the orifice into the beverage in the body of the container.

It is preferred that the insert is precharged with a non-oxygen containing gas such as carbon dioxide, nitrogen, or a mixture of these during manufacture. The insert is preferably precharged to a superatmospheric pressure, however, it is also possible for it to be partially evacuated or, only to be filled with non-oxygen containing gas at substantially atmospheric pressure when initially inserted into the container. When the insert is precharged to a superatmospheric pressure it may be held under this superatmospheric pressure whilst it is inserted into the container and the entire container and insert held under this superatmospheric pressure whilst it is filled. However, this is not preferred since it requires the use of non-conventional equipment. What is preferred is for the insert having been precharged with non-oxidizing gas to be stable and completely closed when exposed to the atmosphere before being inserted into the container. One way in which this is achieved is by having the insert filled with non-oxidizing gas at substantially atmospheric pressure and for the pressure inside the insert to be built-up after the insert is placed in the container and the container filled with beverage. There are various ways in which this can be achieved. Firstly, the insert may be wholly, or at least partly, made from a material which is permeable by gas used to fill and pressurize the container. In this way, during a period after filling of from one to six weeks the permeable nature of the insert allows gas in solution in the beverage inside the container, for example carbon dioxide, to permeate through the walls of the insert until equilibrium is reached between the gas inside the insert and that inside the container. Another way in which the pressure inside the insert can be built up is for the insert to be arranged to change its volume after it has been placed inside the container, the container filled with beverage and sealed. This can be achieved either as a result of the increase in pressure which occurs inside a filled container after it is sealed, and particularly during a pasteurisation step or, alternatively, as a result of a change in temperature, again during a pasteurisation step which occurs after the containers have been filled.

When the insert changes its volume as a result of the increase in pressure that builds up in the container after it is filled and sealed the insert may be arranged to collapse or concertina and include a mechanical lock so that, once collapsed or concertinaed, the insert is then held into its collapsed or concertinaed condition irrespective of subsequent changes in pressure inside the container. On collapsing the pressure inside the insert increases considerably as a result of the reduction in the volume of the insert and, since the insert is locked into its collapsed state, it then holds gas at a much higher pressure than when first inserted into the container. One way in which the insert can be shaped so that it collapses is for it to include one or more domed faces which, upon application of a pressure evert into a stable state.

Another way in which the insert can be made to contract and compress gas contained within it is to manufacture the insert from biaxially stretched plastics material. Such material is biaxially stretched whilst hot and then cooled to lock it into its biaxially stretched orientation. However, as soon as such material is subsequently heated its plastic memory causes it to shrink. Thus, the insert may be made from a biaxially oriented material such as biaxially oriented polyethylene terephthalate (PET) and filled with gas substantially at atmospheric pressure. Then on pasteurisation of the filled containers the insert shrinks considerably in volume so compressing the gas within the insert substantially to the pressure subsisting within the container. As the container and its contents cool the insert is again locked into shape.

Preferably the insert is charged to a superatmospheric pressure before being placed in the container and includes valve means which ere arranged so that they initially resist a substantial pressure difference and yet which, after having been loaded into the container and the container having been filled and sealed have very much lower pressure differential thresholds. Again, use can be made of the subsequent pasteurisation treatment which the container is subjected to after filling to bring about a change in the relief pressure of the valve means. In one example the insert includes a flexible wall including an orifice surrounded by a valve seat and the valve closure member is initially held by the flexible wall in permanent contact with the valve seat. However, once the insert has been subjected to the increase in pressure that builds up inside a container after it is closed and sealed the wall of the insert flexes inwards and brings the valve closure member into engagement with a projection from an opposite face of the insert. Means are provided to interlock the projection and the valve closure member so that when the flexible wall of the insert is in its inwardly flexed condition the projection and valve closure member are interlocked. All the while that the insert is subjected to an external pressure which is higher than or equal to the pressure inside it the valve closure member is still held against the seat to close the insert. However, as soon as the pressure inside the insert is greater than that outside the flexible wall flexes outwards and, since the valve closure member is now held by the projection it is pulled away from the valve seat to allow superatmospheric gas from inside the insert to vent through the orifice.

When the insert includes two opposed faces with the orifice and seating formed on one face and the valve closure member attached to the inside of the other face and extending to the seating on the inside of the one face with the opposed faces arranged to flex as a result of pressure differences between the inside and outside of the insert, a physical change in the properties and characteristics of the opposed faces can be caused during pasteurisation with the result that the pressure at which the valve opens varies. Typically, for example, the insert is precharged with a non-oxygen containing gas to a superatmospheric pressure of 2 or 3 Bar and the pressure responsive valve is arranged to remain closed under this pressure differential. After the insert is placed in a container and the container filled with beverage and sealed the container is then subjected to a pasteurisation step in which, for example, it is pasteurised for about twenty minutes at a temperature of about 60° C. Under such conditions the pressure inside the container builds up to about 5 Bar thus generating a pressure differential of 1 or 2 Bar between the inside and outside of the insert. At the relatively high temperature of 60° C. for the duration of the pasteurisation step the pressure difference causes the opposite faces of the insert to be urged together and at the relatively high temperature they are stretched inelastically in a generally radial direction. In addition to the insert deformation, the increased temperature causes relaxation of the internal stresses within the insert. The radial stretching and relaxation reduces the radial tension that exists in them and thus changes the pressure differential that is required to open the valve.

When the insert includes a valve with a pressure responsive member the insert may be both pre-charged and made from a permeable material. In this way if the insert is over-charged or prematurely exposed to a significant pressure differential some of its contents are vented but, after the container is filled and pressurised the pressure inside the insert builds up as a result of permeation through its side wall during a period of one to six weeks after filling. This has the further advantage of accommodating any slight leakage from the pressure responsive valve during storage of the container.

Preferably the insert is formed in two parts, a main body portion and a separate lid. In this way, during manufacture and assembly of the insert the body can be precharged easily. The insert may be precharged by closing the lid and the main body portion whilst subjecting the insert to a non-oxidizing gas atmosphere at normal or superatmospheric pressure or, alternatively, the insert may have an inert gas such as liquid or solid carbon dioxide, liquid nitrogen or a mixture of these placed into the main body portion and then, after a brief delay to allow some of the liquid or solid gas to vaporise and displace air from the body of the insert the lid is fitted onto the body to close the insert. As the remaining solid or liquid inert gas vaporises it precharges the insert with a superatmospheric pressure.

The amount of solid or liquid inert gas introduced into the insert is preferably metered to provide the required final pressure. Conveniently this pre-charging of the inserts is carried out by having the body portions fed on a conveyor past a liquid inert gas metering nozzle which dispenses a metered quantity of liquid inert gas into each insert body in turn. The insert bodies are then carried by the conveyor to a capping station at which the lids are fitted. The separation between the liquid gas metering nozzle and the capping station and the speed of the conveyor are chosen to provide the time delay required to displace air from the body. The lid is preferably a simple snap-fit on the body but, alternatively it may be connected by a screw-thread, by welding or by an adhesive, for example.

The insert may be an interference fit with the side wall of the container so that it is held in position. Alternatively, it may merely float in the liquid in the container and be weighted so that the part from which gas is jetted on opening the container is always arranged towards the base of the insert. When the container is formed by a can the can may be locally deformed to trap the insert at a particular location. In a further version portions of the insert are placed between a side wall of the container and its lid so that the insert is held captive once the lid is fixed on the container.

With the arrangement in accordance with this invention the insert is always completely closed when it is inserted into the container and thus, the container requires no additional flushing and purging steps other than those required for a conventional container filling operation. Thus, the present invention has considerable advantages over the commercially operated version of the system described in GB-A-2183592 and yet still uses standard containers such as standard metal cans or plastics or glass bottles and the containers can be handled by standard container filling machinery once the inserts have initially been loaded into the containers.

BRIEF DESCRIPTION OF THE DRAWINGS

Particular examples of containers in accordance with this invention will now be described with reference to the accompanying drawings, in which:

FIG. 11 is a cross-section through an insert with a fourth example of closure means;

FIGS. 12 and 13 are a cross-section and plan respectively of a main body portion of the insert shown in FIG. 11;

FIGS. 14 and 15 are a cross-section and plan respectively of a first cap of the insert shown in FIG. 11;

FIGS. 16 and 17 are a cross-section and plan respectively of a secondary cap of the insert shown in FIG. 11;

Figure 1:
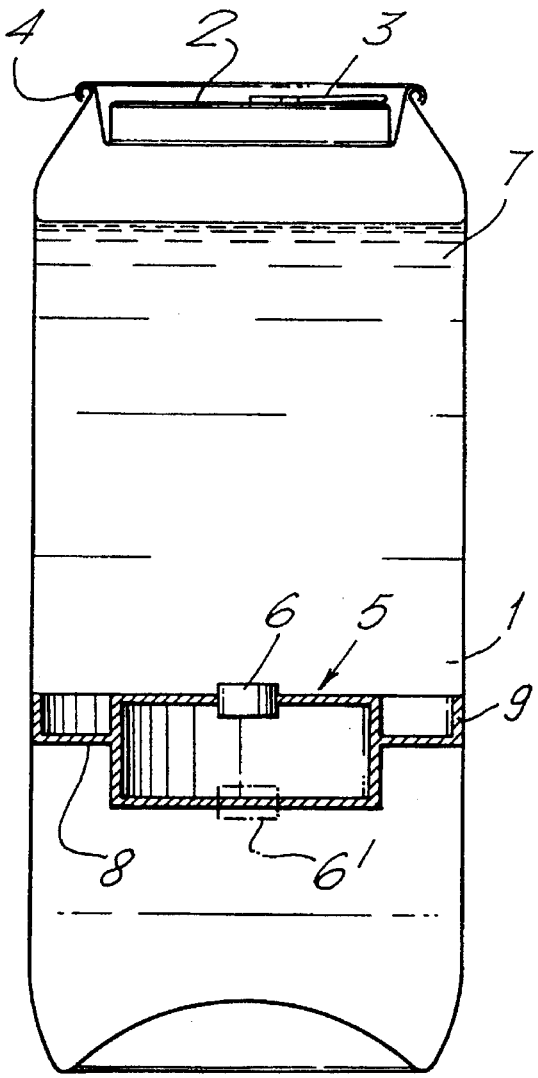
FIG. 1 is a cross-section through a first example of can containing an insert.

In all these examples the container has the form of a can 1 with a lid 2 including a non-resealable closure 3 such as a tear-off ring pull or a stay-on tab. The lid 2 is joined onto the upper rim of the can 1 by a folded seam 4. The can 1 also contains a hollow insert 5 having a volume typically between 5 and 20 ml which is filled with carbon dioxide, or nitrogen or a mixture of these and which has one of a variety of forms to be described in detail subsequently. All include some closure means 6 through which gas from the insert 5 is vented. The can 1 is also filled with a beverage 7 such as a beer. Whilst the non-resealable closure 3 is closed the hollow insert 5 contains only gas and the closure means 6 is closed so that the beverage 7 inside the can 1 is prevented from entering the hollow insert 5. However, upon opening the non-resealable closure 3 the pressure inside the can 1 is reduced to atmospheric, whereupon the superatmospheric pressure of the gas inside the hollow insert 5 causes gas to be vented through the closure means 6 to provide a jet of gas into the beverage 7. The jet of gas causes shear in the beverage 7 with a resulting liberation of a number of small bubbles which, as they rise through the beverage 7 in the can 1, form nucleation sites which trigger the liberation of further small bubbles throughout the beverage 7. Thus, as the beverage 7 is poured out of the can 1 and into a receptacle such as a drinking glass the bubbles are intimately mixed with the beverage and give the appearance of dispensing the beverage from draught. Whilst the closure means 6 is shown located in the top of the insert 5 in FIG. 1 it may also be located in the base as shown at 6' or at the side of the insert 5.

Figure 2:
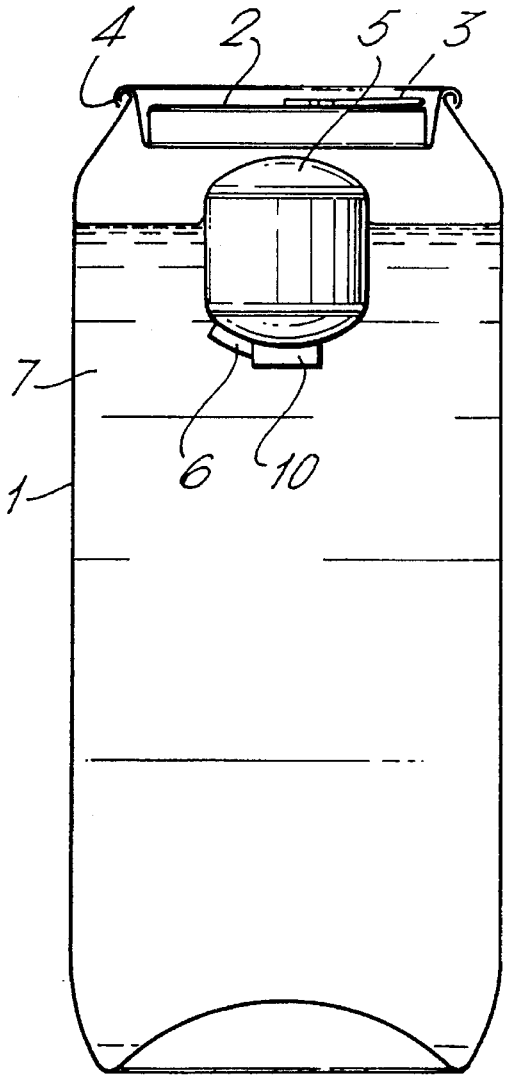
FIG. 2 is a cross-section through a second example of can containing an insert.
Figure 3:
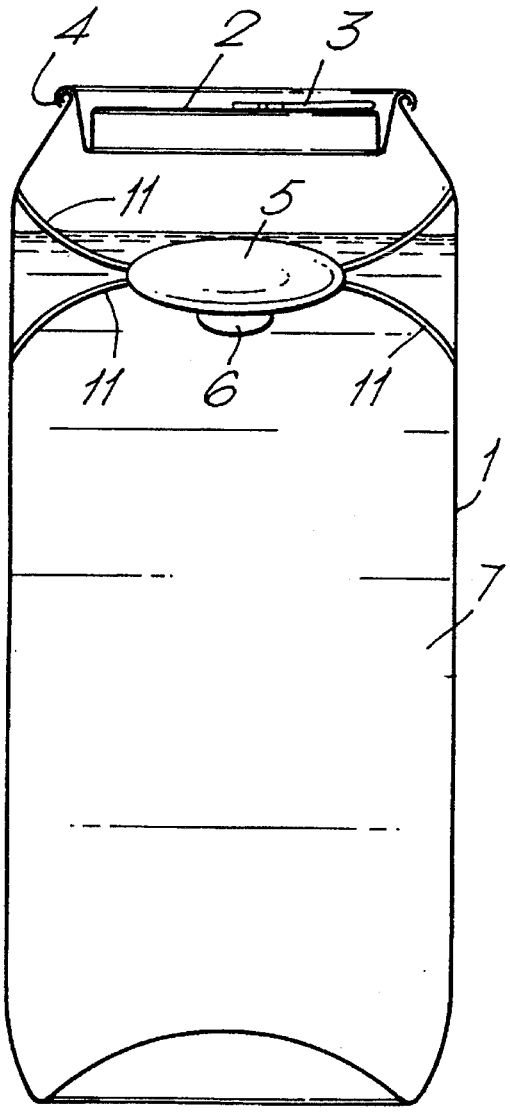
FIG. 3 is a cross-section through a third example of can containing an insert.
Figure 4:
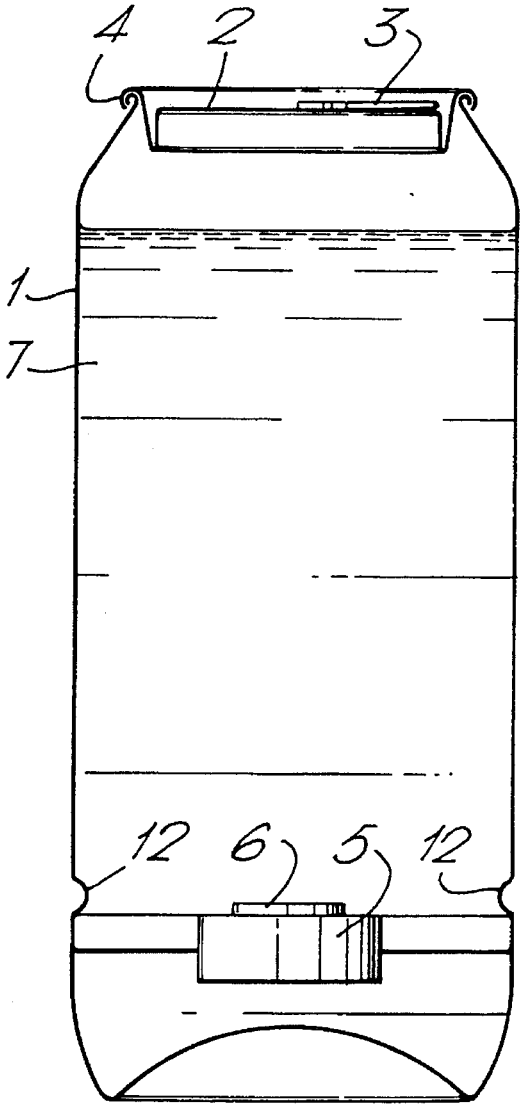
FIG. 4 is a cross-section through a fourth example.

The hollow insert 5 may include arms 8 with flanges 9 which are an interference fit on the internal side wall of the can 1 as shown in FIG. 1 to hold the insert 5 in position inside the can 1. The side wall of the can 1 may include internal protrusions to help retain the insert 5. Alternatively, as shown in FIG. 2, the insert 5 may float in the beverage 7 and include a weight 10 so that it is always oriented in a particular direction inside the can 1. In a third example shown in FIG. 3 the insert 5 includes flexible arms 11 which again engage the inner side wall of the can 1 to hold the insert 5 in position. Again the side wall of the can 1 may include internal protrusions to help retain the insert 5. In another example shown in FIG. 4 the side wall of the can is deformed after insertion of the insert by forming radially inwardly projecting protrusions 12 which hold the insert 5 in position adjacent the base of the can 1. As further options, not illustrated, the insert may be glued in position on the inside of a can 1, be held against the side wall or base of the can 1 by including, or being formed as a "sucker" or, alternatively, flange 8 of the insert 5 may be trapped in the seam 4 between the lid 2 and the can 1 as described in our co-pending patent application no. PCT/GB90/01017.

Various different closure means 6 will now be described. All are generally usable with any of the above forms of insert 5. All react to a pressure differential between the inside of a hollow insert 5 and the inside of a can 1 by opening to allow the superatmospheric pressure inside the insert 5 to jet gas from inside the insert 5 into the beverage 7 in the container 1.

Figure 5:
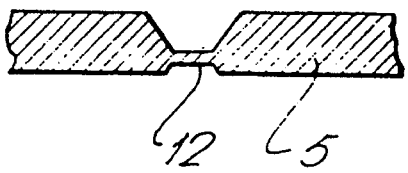
FIG. 5 is a scrap cross-section of a first example of closure means.

The first example of closure means 6 provides a small burst disk 15, as shown in FIG. 5 formed in the wall of the insert 5. In this example the wall of the insert 5 contains a small area of very thin section 15 and this thin section bursts at a pressure differential of, for example, 1.3 Bar to provide an aperture of about 0.1 mm diameter.

A support may be provided on the inside of the insert 5 to prevent the disk 15 bursting inwards, for example during pasteurisation.

Figure 6:
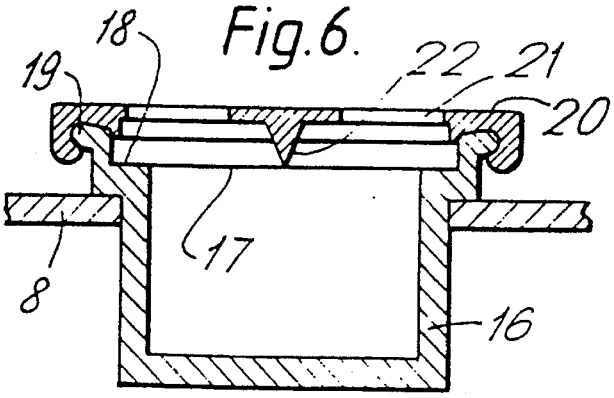
FIG. 6 is a cross-section through an insert having a second example of closure means in a first condition.
Figure 7:
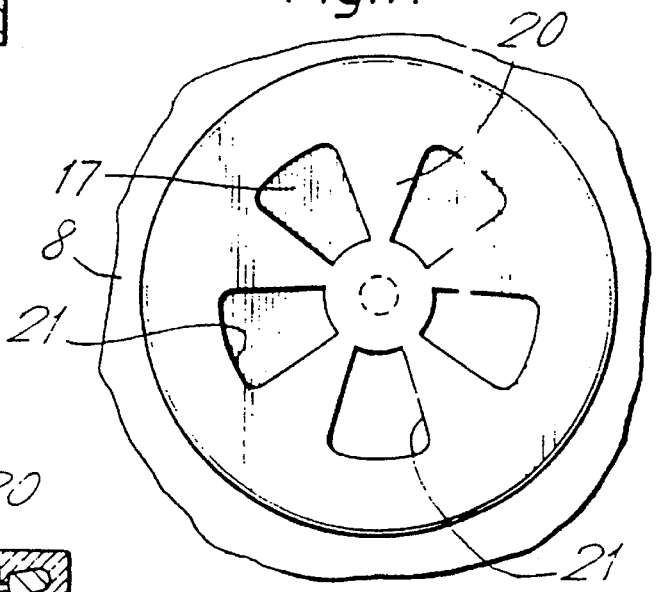
FIG. 7 is a plan through the insert shown in FIG. 6.
Figure 8:
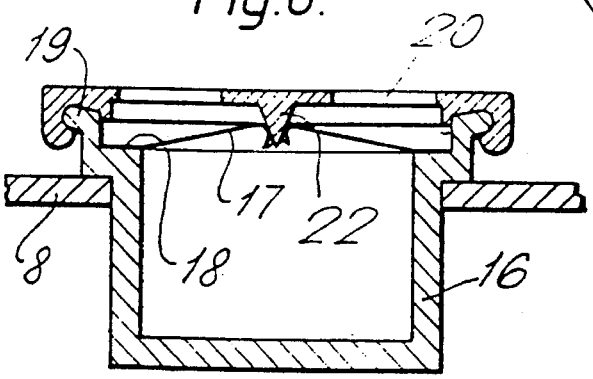
FIG. 8 is a cross-section through the insert shown in FIG. 6 in a second condition.

The second example of closure means, shown in FIGS. 6, 7 and 8 comprises a cup-shaped insert 16. This is filled with gas and closed and sealed by a thin membrane 17 of aluminium or plastics film. The membrane 17 is typically heat sealed or glued to a flange 18. A rounded upper rim 19 of the cup-shaped insert 16 has a cap 20 snap fitted onto it. The cap 20 includes apertures 21 and a downwardly projecting spike 22 which initially rests lightly on the surface of the membrane 17.

After insertion in the can 1 the pressure inside the insert builds up as will be described in detail subsequently until it is in substantial equilibrium with the pressure inside the can 1. Provided the pressure inside and outside is substantially the same then the membrane 17 remains generally planar as shown in FIG. 6. Upon opening the ring-pull 3 however the pressure inside the insert 5 is very much greater than that of the atmosphere and accordingly the membrane 17 bows outwards and ruptures against the spike 22 so that gas is jetted from the insert 5 into the beverage 7 in the can 1.

Figure 9:
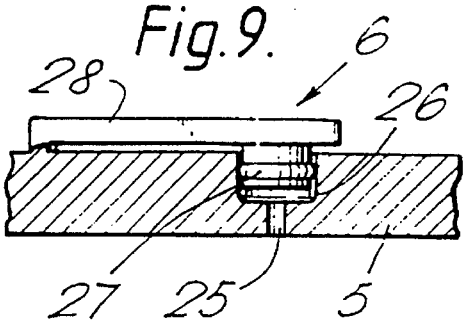
FIG. 9 is a scrap cross-section through a third example of closure means in a first condition.
Figure 10:
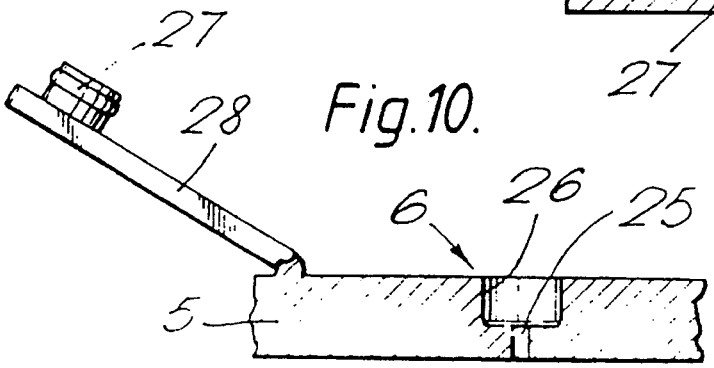
FIG. 10 is a scrap cross-section through the third example of closure means in a second condition.

In a third example the closure means 6 are formed by an aperture 25 of small diameter such as 0.3 mm leading in to an aperture 26 of larger diameter such as 10 mm. A captive plug 27 connected to the side wall of the insert by a strap 28 is initially inserted into the bore 26 completely to close the aperture 25 and hence close the hollow insert 5 as shown in FIG. 9. However, when subjected to a pressure differential greater than that required to overcome the friction between the plug 27 and the wall of the aperture 26 as a result of opening the non-resealable closure 3 in the lid 2 of the can 1 the pressure inside the insert 5 drives the plug 27 out of the aperture 26 to allow gas from inside the insert to be jetted through the fine aperture 25 as illustrated in FIG. 10.

A fourth example of closure means is shown in FIGS. 11 to 17. This example comprises a cup-shaped insert 30 with a rounded rim 31 and connected to arms 8 with a flange 9 which is an interference fit on the internal side wall of the can, and a lid 32 including an aperture 33 of small diameter. The small aperture 33 has a diameter of 0.3 mm and also includes an annular groove 34 which cooperates with the rounded rim 31 to provide the snap-fit engagement. A secondary cap 35 including a rim 36 fits around the outside of the cap 32. The rim 36 forms an interference fit with the outer diameter of the cap 32.

When the insert 5 is present inside a can 1 the pressure inside the insert 5 is substantially in equilibrium with the contents of the can and the way in which it is achieved is by one of the various ways described subsequently. Upon opening the can by releasing the closure 3 a substantial pressure differential exists across the faces of the secondary cap 35 as a result of the pressure inside the insert 5 acting via the small orifice 33. This is sufficient to overcome the interference fit between the rim 36 and the outside of the cap 32 to cause the secondary cap 35 to blow off. Gas from inside the insert 5 is then jetted via the small orifice 33 causing shear in the beverage and the liberation of small bubbles throughout the beverage 7. The blowing off of the cap causes a shock wave throughout the beverage 7 which also liberates further small bubbles of gas from the beverage.

Figure 18:
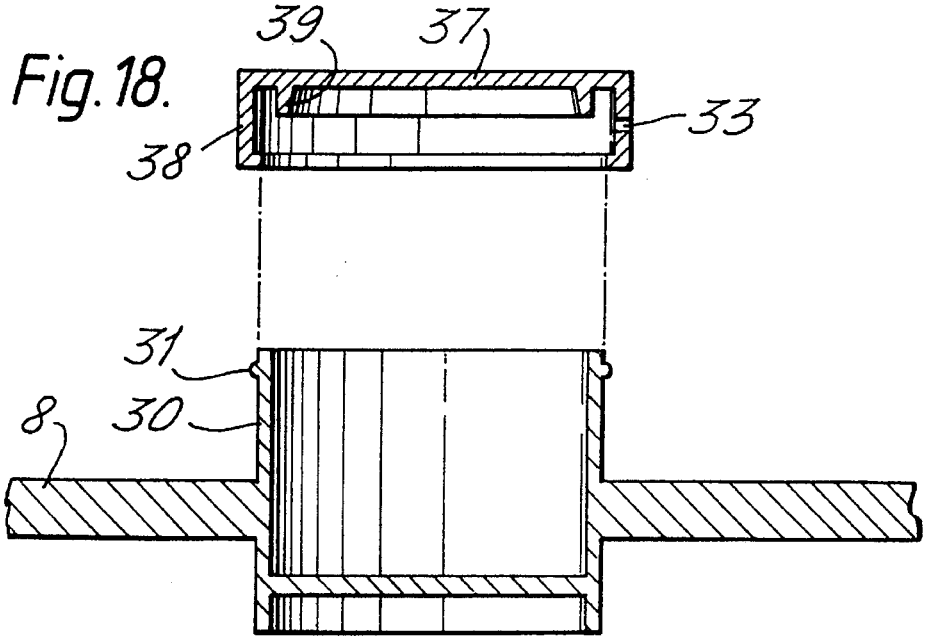
FIG. 18 is an exploded cross-section through an insert with a fifth example of closure means.
Figure 19:
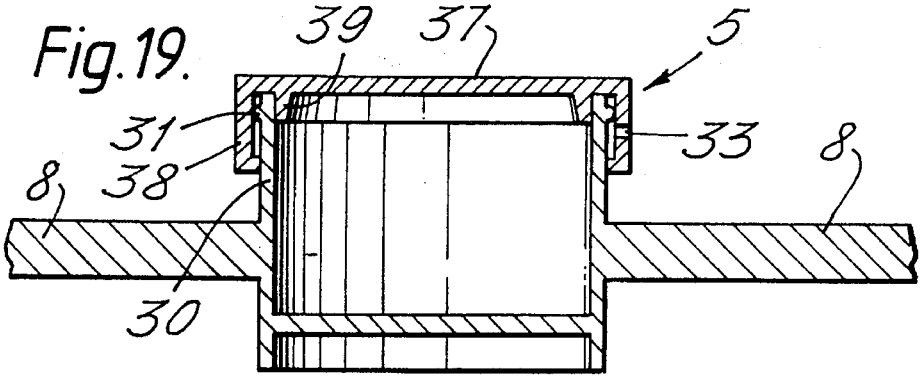
FIG. 19 is a cross-section through the assembled insert shown in FIG. 18 in a first condition.
Figure 20:
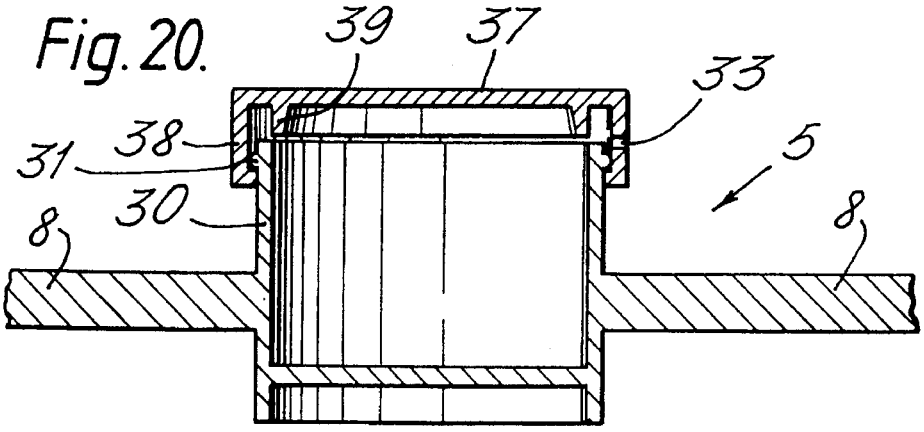
FIG. 20 is a cross-section through an assembled insert shown in FIG. 18 in a second condition.

The fifth example which is shown in FIGS. 18 and 19 is a further refinement of the fourth example. Again it comprises a cup-shaped body portion 30 with a rounded projecting rib 31 formed around the outside of its open end. In the fifth example the insert includes a single cap 37 having an inturned rim 38 and an internal annular projection 39. A small aperture 33 is formed in the inturned rim 38. The insert 5 is loaded with an inert gas and the cap 37 fitted on to it. The cap 37 is pushed completely on to the cup-shaped portion 30 so that the outside of the annular projection 39 forms a tight seal with the inner surface of the rim at the open end of the cup-shaped portion 30. The open rim is further supported by the rounded projection 31 engaging the inturned rim 38 of the cap 37 which further ensures the integrity of the seal formed between these regions. When the insert 5 is subjected to a substantial pressure difference the cap 37 is driven axially away from the body 30 until the inturned portions of the rim 38 engage the projecting rib 31. In this position the seal formed between the annular projection 39 and the open end of the portion 30 is broken so that the gas from inside the insert 5 is jetted into the beverage 7 via the small diameter orifice 33.

Figure 21:
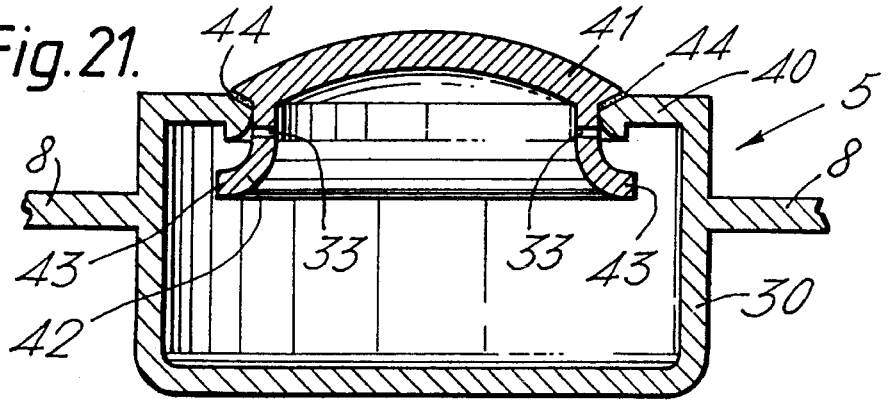
FIG. 21 is a cross-section through an insert including a sixth example of closure means in a first condition.
Figure 22:
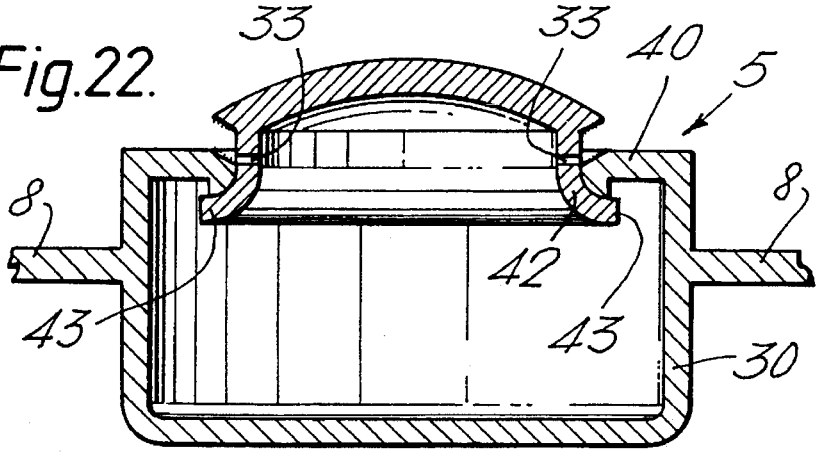
FIG. 22 is a cross-section through the insert shown in FIG. 21 in a second condition.

A sixth example shown in FIGS. 21, 22 is somewhat similar to the fifth example except that the cup-shaped portion 30 includes an inwardly directed annular projection 40 and in that the cap 41 has a depending flange 42 with an out-turned end 43. Small diameter apertures 33 are provided in the flange 42. After the body 30 has been filled with gas the cap 41 is urged into it to close its open end and seal the insert. The cap 41 may be retained by an interference fit as in the fifth example or may be secured in position with an adhesive 44. The function of the adhesive will be described in detail subsequently.

Again, the pressure inside the insert 5 is substantially the same as that in the filled can and, upon opening the can 1 the superatmospheric pressure inside the insert 5 causes the cap 41 to move outwards into the position shown in FIG. 22. The gas is then vented via the apertures 33 into the beverage 7 in the can 1.

Figure 23:
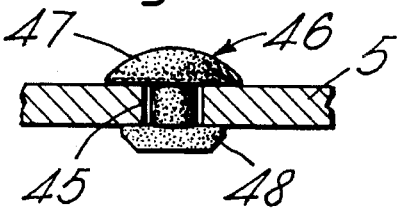
FIG. 23 is a scrap cross-section through a seventh example of closure means.
Figure 24:
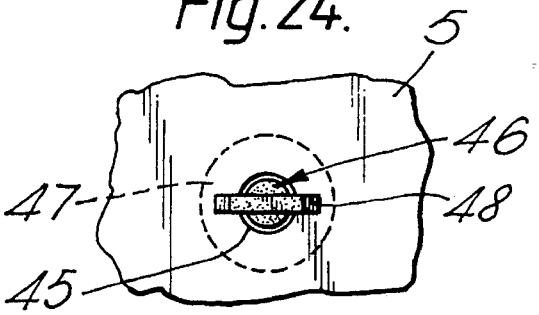
FIG. 24 is an underplan of the seventh example of closure means.

A seventh example of closure means 6 is shown in FIGS. 23 and 24. In this example an aperture 45 in the wall of the insert 5 has a rubber or rubber-like bung 46 inserted into it to close it. The bung 46 includes an enlarged head portion 47 and a toggle portion 48 which holds the bung 46 captive in the hole 45. The head portion 47 of the bung 46 normally seals against the outer surface of the insert 5 to maintain it closed. However, when sufficient pressure differential exists between the inside of the insert 5 and the inside of the can 1 the bung 46 distorts to allow gas to leak through the hole 45 and underneath the head 47 of the bung 46 to provide a jet of gas from inside the insert 5.

Figure 25:
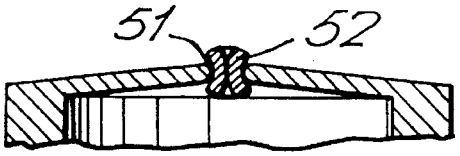
FIG. 25 is a scrap cross-section through an eighth example of closure means in a first condition.

In the eighth example the insert 5 is formed by a generally closed circular body which may be formed in two parts. One circular face 50 of the insert 5 includes a central aperture 51. A tubular portion 52 of rubber of rubber like elastomeric material is inserted in the bore 51. The fit between the bore 51 and the tubular portion of rubber or rubber like elastomeric material 52 is arranged so that when the circular face 50 is substantially planar, as shown in FIG. 25, that is when the pressure inside the insert 5 is substantially the same as that outside then the aperture through the middle of the tubular insert 52 is pinched off by the sides of the aperture 51, again as shown in FIG. 25. However, when the pressure inside the insert 5 is considerably greater than that outside, the insert 5 tends to bulge so that its circular face 50 has a generally conical form as shown somewhat exaggerated in FIG. 26. This reduces the pressure exerted by the sides of the aperture 51 on the insert 52 allowing a central aperture 53 in the insert 52 to open up to allow gas to be jetted through the aperture 53 into the beverage in the container 1.

Figure 27:
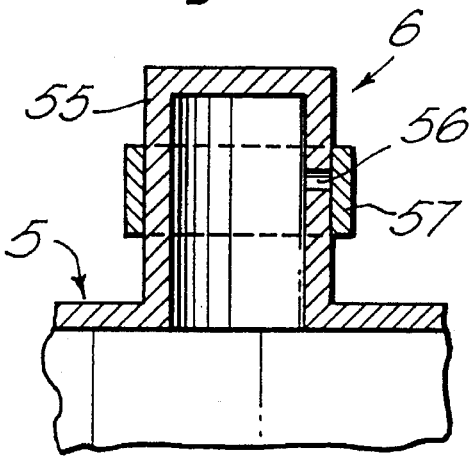
FIG. 27 is a scrap cross-section through a ninth example of closure means.

In the ninth example the insert 5 includes a pressure responsive valve generally similar to those used on bicycle tires, see FIG. 27. Thus, the insert 5 includes a hollow spigot 55 including a small aperture 56 of diameter 0.5 mm. A rubber or rubber like elastomeric sleeve 57 surrounds the outside of the spigot 55 and covers the small aperture 56. The sleeve acts as a valve to prevent ingress of liquid from the beverage 7 inside the can 1 via the aperture 56 but, when the pressure inside the insert 5 is greater than that outside gas is vented from inside the insert 5 through the small aperture 56 and forces the sleeve 57 away from the surface of the spigot 55 so that the gas can escape between them.

Figure 28:
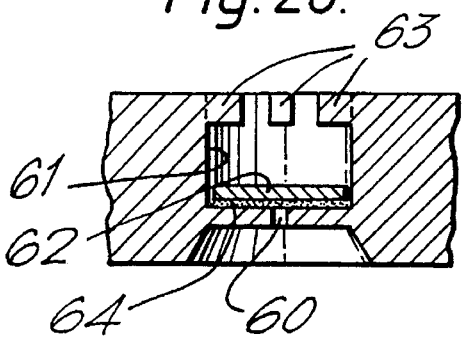
FIG. 28 is a scrap cross-section through a tenth example of closure means.
Figure 29:
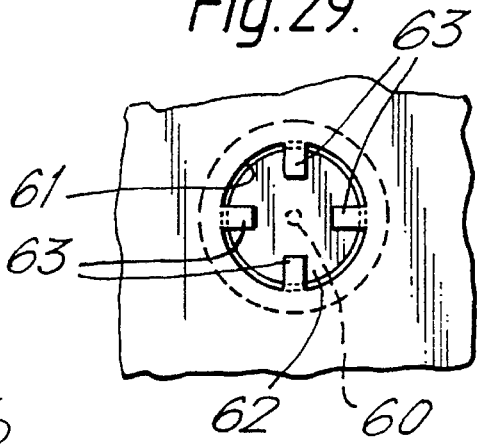
FIG. 29 is a plan of the closure means shown in FIG. 28.

The tenth example of closure means 6 is shown in FIGS. 28 and 29. In this example the wall of the insert 5 includes a small diameter aperture 60 leading into a chamber 61 of considerably greater diameter. The chamber 61 houses a sealing plate 62 which is retained in place by lugs 63 adjacent the open end of the chamber 61. When the pressure outside the chamber 5 is greater than that inside, the sealing plate 62 is urged against the base of the chamber so sealing the small diameter aperture 60. When the pressure inside the chamber 5 is greater than that outside, the plate 62 lifts from its seat to allow gas from inside the insert 5 to escape via the small diameter aperture 60 and around the side of the plate 62. Adhesive 64 may be provided between the plate 62 and its seat so that the plate can be adhered in position to resist an initial pressure difference between the inside of the insert 5 and the outside. Again, the function of this adhesive will be described in more detail subsequently.

Figure 30:
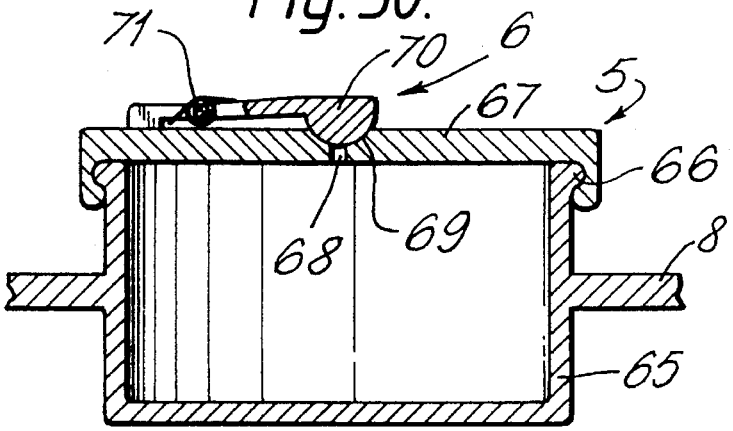
FIG. 30 is a cross-section through an insert including an eleventh example of closure means.

In the eleventh example the insert 5 comprises an open topped cup-shaped container 65 with a rounded projection 66 extending radially outwards around its open rim as shown in FIG. 30. A lid 67 includes a small diameter orifice 68 surrounded on its outer surface by a generally hemispherical seating surface 69. A hemispherical sealing member 70 is urged into the hemispherical seating surface 69 by a clothes pin type spring 71 and normally seals the small diameter aperture 68. The sealing member 70, and hemispherical seating surface 69 provide a pressure responsive valve assembly with the relief pressure of the valve assembly being determined by the strength of the clothes pin type spring 71. When the pressure inside the chamber 5 exceeds the pressure differential required to lift the sealing member 70 from its seating 69 gas is vented from inside the insert 5 through the orifice 68 and into the beverage 7 in the can 1.

Figure 31:
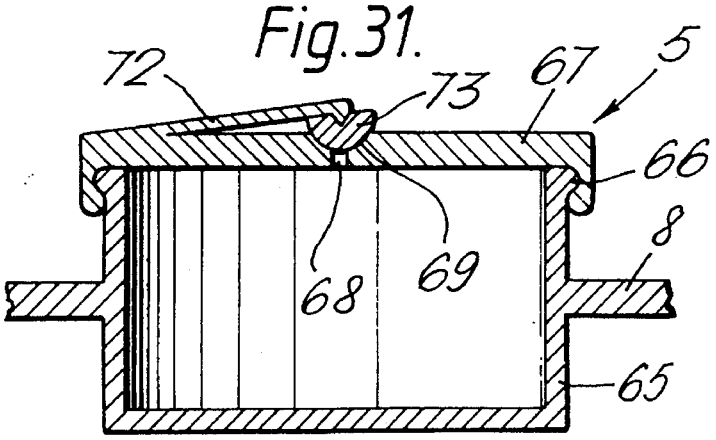
FIG. 31 is a cross-section through an insert including a twelfth example of closure means.

The twelfth example is generally similar to the eleventh only, in this case, instead of having a clothes pin type spring 71, a lever 72 is provided which is formed integrally with the lid 67 and which acts as a cantilever spring to hold a sealing member 73 in place closing the small diameter orifice 68 and engaging the hemispherical seating surface 69 as shown in FIG. 31. This example works in exactly the same way as the previous example.

Figure 32:
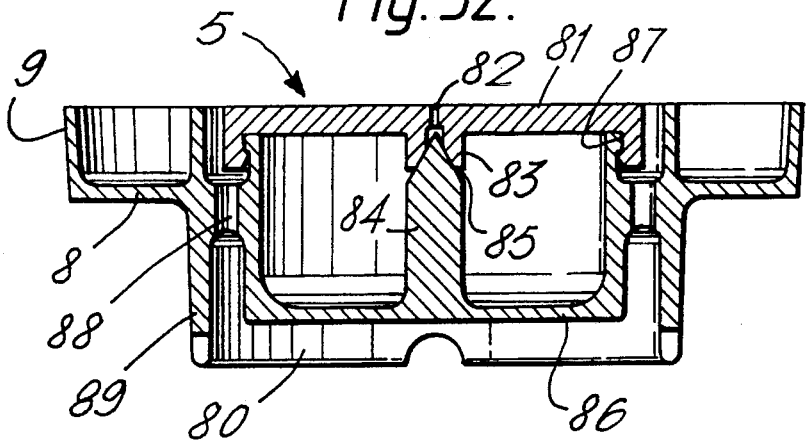
FIG. 32 is a cross-section through an insert with a thirteenth example of closure means.
Figure 33:
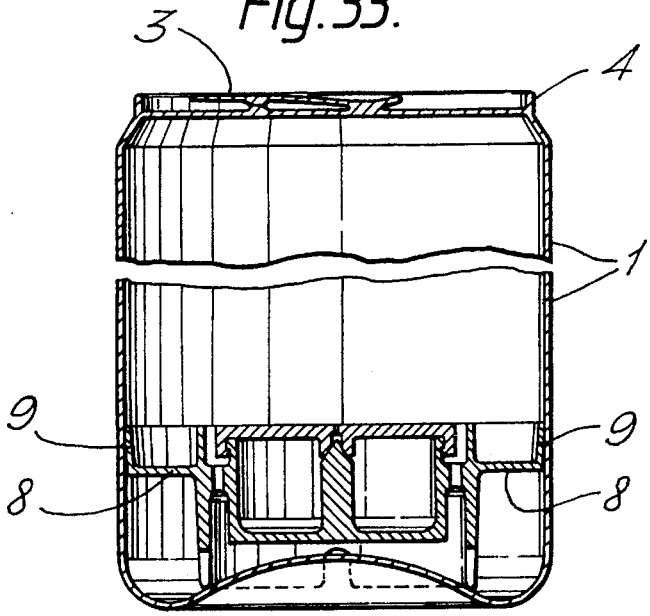
FIG. 33 is a cross-section through a can showing the insert of FIG. 32 in place.
Figure 34:
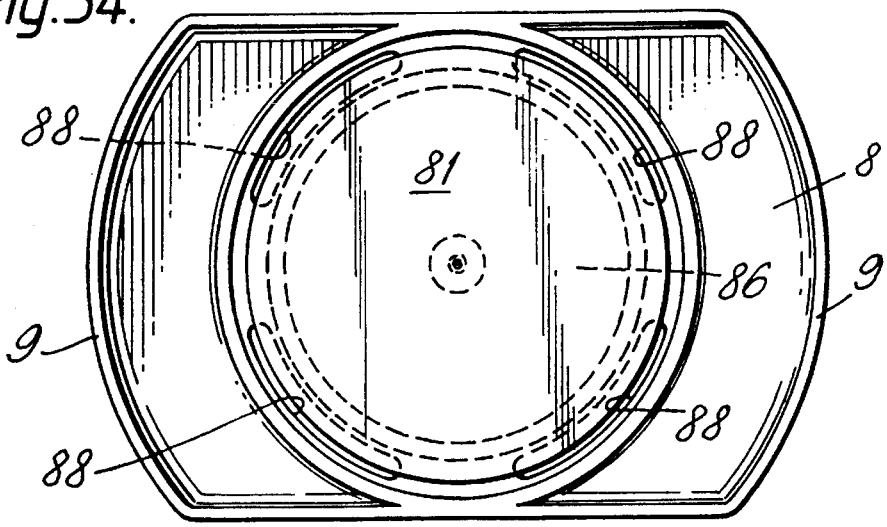
FIG. 34 is a plan of the insert shown in FIG. 32.
Figure 35:
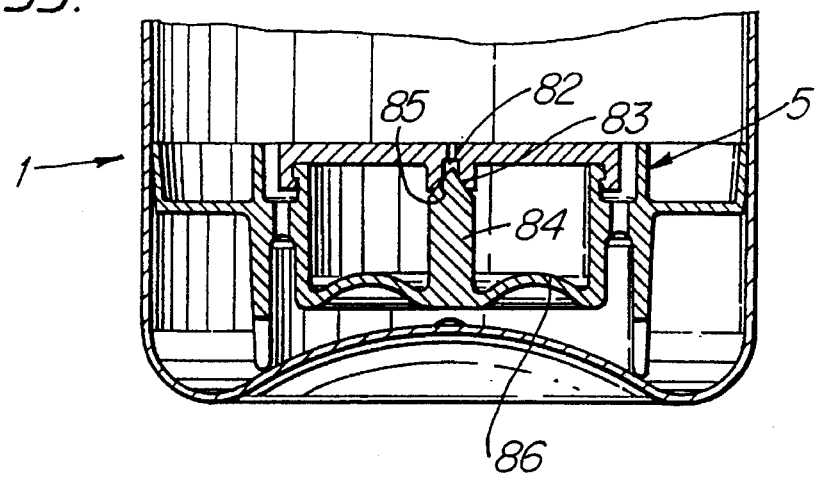
FIG. 35 is a cross-section showing how the insert is deformed during pasteurisation.
Figure 36:
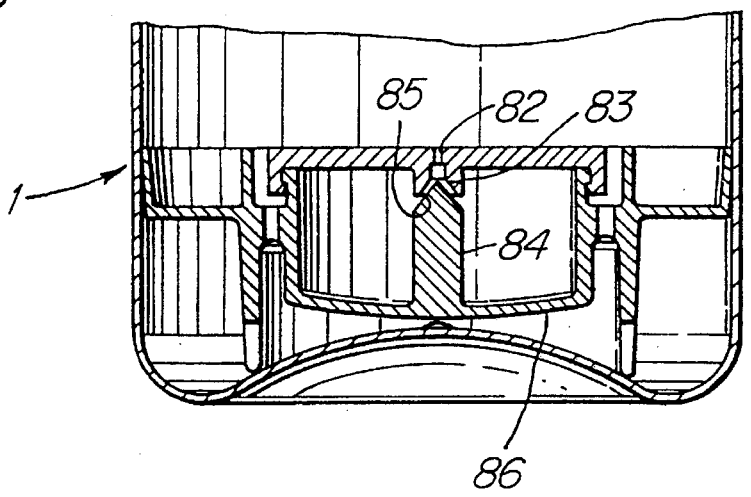
FIG. 36 is a cross-section showing the insert jetting gas on opening the can.

A thirteenth example of the closure means 6 is shown in FIGS. 32 to 36. FIGS. 32 and 34 show the insert on its own whilst FIGS. 33, 35 and 36 show it in place in the base of a can 1. The insert 5 is injection molded in two parts, a main body portion 80 and a lid 81. The lid includes a restricted orifice 82 having a diameter of typically 0.3 mm surrounded on its inside by an annular generally conical seating 83, a valve closure member 84 having a corresponding conical seating surface 85 is moulded integrally with a face 86 of the main body portion 80. The lid 81 is a snap-fit on the body 80 by virtue of a radially outwardly projecting annular rib 87 and annular recess in the skirt of the overlapping rim of the lid 81. When the lid 81 is fitted onto the body 80 the conical seating surface 85 seals against the seating 83 to form a valve which blocks the passage of gas from inside the insert through the restricted orifice 82. Equally, the entry of liquid vie, the orifice 82 into the insert 5 is also blocked. The insert 5 is generally oval in shape as shown most clearly in FIG. 34 and apertures 88 are provided between the hollow insert and a surrounding skirt 89 to allow for the passage of beverage.

The lid 81 is assembled with the main body portion 80 of the insert 5 in a nitrogen atmosphere at a superatmospheric pressure of 2 to 3 Bar. The insert 5 is then placed into a can 1. The can 1 is then filled with beer 7, dosed with liquid nitrogen and has the lid 3 sealed on in a conventional can filling machine. After sealing of the lid 3 the pressure inside the can 1 builds up considerably. As the pressure outside the insert 5 increases the lid 81 and face 86 tend to be forced together more firmly so, more firmly driving the seating surfaces 83 and 85 together. After filling the can is subjected to an in-can pasteurisation process during which it is heated to a temperature of around 60° C. for a period of around 20 minutes. During this time, the pressure inside the can builds up to a pressure of at least 4 Bar and this again results in the lid 81 and wall 86 being forced together. At a temperature of about 60° C. the plastic material from which the insert 5 is injection molded tends to distort inelastically with the result that at least the base wall 86 is deformed as shown in FIG. 35 since the pressure inside the can is considerably higher than the pressure inside the insert 5. In addition to the insert deformation the increased temperature causes relaxation of the internal stresses within the insert. After pasteurisation the can and its contents cools down and, since the pressure in the can is still higher than the 2 Bar inside the insert 5 the wall 86 and lid 81 are still urged together to keep the seating surfaces 83 and 85 in tight engagement. Upon opening the closure 3 the inside of the can is immediately reduced to atmospheric pressure. At this point, and as a result of the distortion and stress relaxation that has occurred during pasteurisation, the pressure inside the insert 5 can now urge the hall 86 away from the lid 81 so separating the sealing surfaces 83 and 85 and allowing gas from inside the insert 5 to be jetted via the small diameter orifice 82 into the beer in the can 1.

The change of state which occurs in the insert 5 during pasteurisation changes the blow off pressure of the pressure release valve so that it has a lower blow off pressure after pasteurisation than before. This ensures that the insert 5 can be charged to an over pressure before being inserted in the can 1 without any risk of the gas it contains being vented but, equally ensures that, after pasteurisation, when the can is opened the closure means 6 opens to jet gas from the insert 5.

Figure 26:
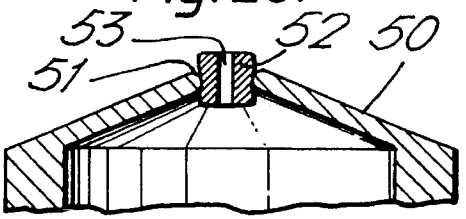
FIG. 26 is a scrap cross-section through the eighth example of closure means in a second condition.

A similar effect can be achieved as a result of the change in state of the material forming the cantilever spring 72 in the example shown in FIG. 31 and in the strength of the wall 50 in the example shown in FIG. 25 and 26. Thus, in all of these cases a differential can be achieved between the relief pressure of the closure means 6 when the insert 5 is initially charged with gas as compared to its relief pressure when the can 1 is opened. Other ways in which this can be achieved using the temperature resulting from a pasteurisation process involves the use of a heat and/or liquid sensitive adhesive. By making the adhesive 44 or 64 in the examples shown in FIGS. 21 and 22 or FIGS. 28 and 29 respectively from an adhesive which is heat or liquid sensitive, the insert, when first manufactured and charged, can resist a high superatmospheric pressure. However, after being loaded into the container and, particularly after being subjected to a pasteurisation process the adhesive bond is broken so that, thereafter, closure means 6 merely responds to differences in pressure between the inside and outside of the insert 5.

The fourteenth example has similarities to example thirteen but uses a different technique to provide a differential pressure between when it is initially charged and when the container is subsequently opened.

Figure 40:
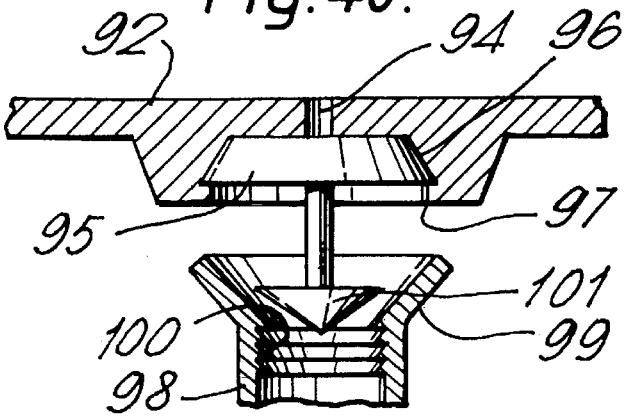
FIG. 40 is a scrap cross-section drawn to an enlarged scale of the fourteenth example of closure means.

The fourteenth example is shown particularly in FIGS. 37 to 40. The insert 5 comprises an open ended cup-like portion 90 with a radially outwardly projecting rib 91 around its rim. A lid 92 including portions of reduced thickness 93 and a central, small diameter aperture 94 is arranged to be a snap fit on the rib 91. A valve closure member 95, which is shown most clearly in FIG. 40 is held against the underside of the small diameter aperture 94 and seats against a frusto-conical surface 96. The valve closure member 95 is held in place in the lid 92 by slightly inturned portions 97 at the end of the frusto-conical surface 96. A tubular portion 98 extends upwards as shown in FIGS. 37 to 40 from the base of the cup-shaped portion 90 and includes a funnel-shaped lead-in portion 99 at its upper end and ratchet teeth 100 on the inside at its upper end. The valve closure member includes a spigot 101 which extends downwards away from the valve closure member 95.

Figure 37:
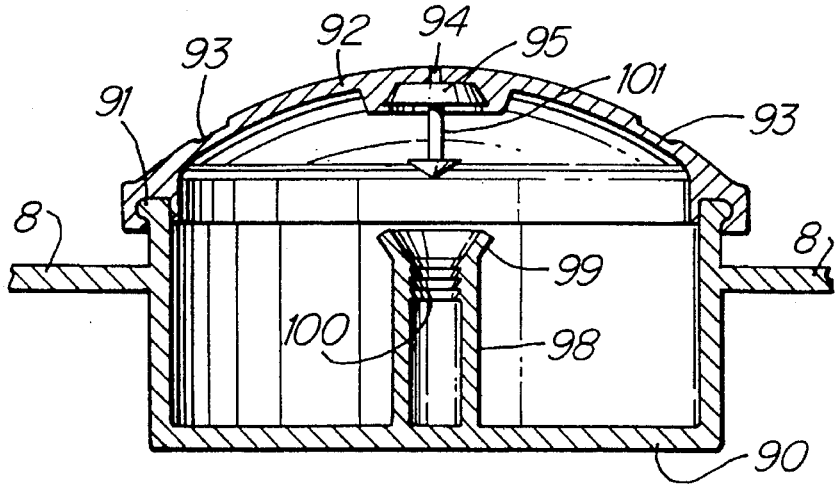
FIG. 37 is a cross-section through a fourteenth example of closure means in a first condition.
Figure 38:
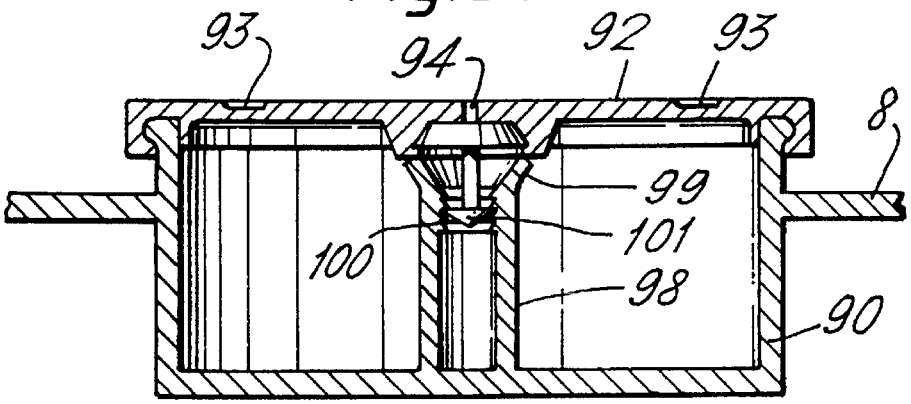
FIG. 38 is a cross-section through the fourteenth example of closure means in a second condition.
Figure 39:
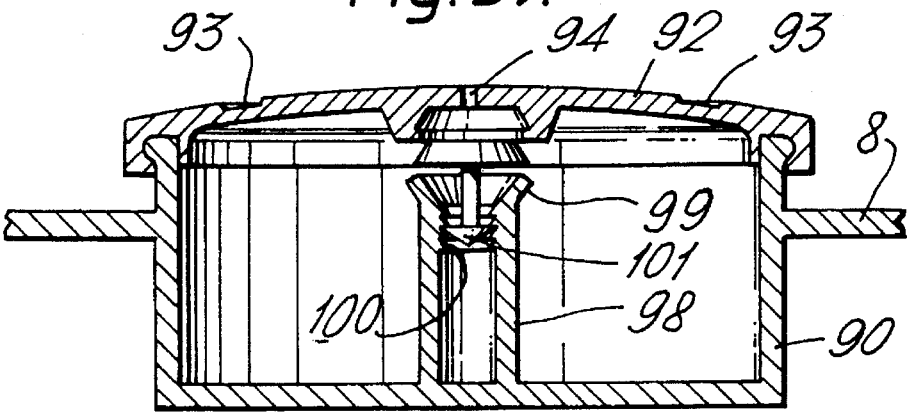
FIG. 39 is a cross-section of the fourteenth example of closure means in a third condition.

The lid 92 having initial configuration shown in FIG. 37 is placed on top of the portion 90 in a nitrogen atmosphere at superatmospheric pressure of around 2 Bar. The valve closure member 95 is held against its seat 96 and consequently the gas is subsequently contained and held inside the insert 5 even when it is exposed to atmospheric pressure. The insert 5 is then loaded into a can 1 which is subsequently filled with beer 7, dosed with liquid nitrogen and sealed in the conventional fashion. As the pressure inside the can 1 builds up and exceeds the 2 Bar pressure inside the insert 5 the lid 92 is urged downwards towards the base of the portion 90. Particularly during a pasteurisation step when the pressure inside the can reaches 4 Bar the lid is urged further downwards towards the base of the portion 90 into position shown in FIG. 38. The spigot 101 is guided by the lead-in portion 9 so that it enters the top end of the tubular portion 98 and engages with the ratchet teeth 100. After pasteurisation is complete the pressure inside the can falls somewhat but is still broadly comparable with that inside the insert 5 so that the insert remains in the condition shown in FIG. 38. However, upon opening of the can 1 the pressure inside the insert 5 then is at a higher pressure than the atmospheric pressure subsisting in the can 1 with a result that the lid 92 bows upwards and outwards. However, on this occasion the valve closure member 95 is held by the inter-engagement of its spigot 101 with the ratchet teeth 100 and thus, as the lid 92 bows upwards the valve closure member 95 is removed from its seat 96 and the gas inside the insert 5 is jetted through the small diameter orifice 94 into the beverage 7 in the can 1.

All of the various inserts described above must be charged with nitrogen or carbon dioxide or a mixture of these or other inert gases to a superatmospheric pressure either before being inserted in a can 1 or at some later stage. Where the closure means 6 is such that it responds to any difference in pressure between the inside and outside of the insert 5 and the insert 5 is precharged with superatmospheric pressure the insert 5 must be maintained under a superatmospheric pressure continuously until the can 1 is opened. Alternatively, some means must be provided for increasing the pressure inside the insert after it is inserted into the can 1.

One way in which this can be done with any of the inserts described previously is for air merely to be displaced from the insert 5 during its assembly or, for example, an oxygen absorber be placed inside the insert during its assembly. If the insert is then placed inside the can 1 and the can dosed with liquid nitrogen or solid carbon dioxide or a mixture of these before the lid 2 is sealed onto its open end the pressure inside the can builds up until it is significantly greater than the pressure inside the insert 5. By making the insert from a low barrier material such as low density polythene, high density polythene or polypropylene, because the partial pressure of nitrogen and/or carbon dioxide inside the container is considerably higher than that inside the hollow insert 5, over an initial period of one to six weeks, the nitrogen and/or carbon dioxide from the can permeates through the wall of the insert until the partial pressures of carbon dioxide and nitrogen inside the insert approach those inside the can. In this way even if the pressure inside the insert 5 when it is initially inserted in the can is atmospheric or less the pressure inside the insert builds up over a period of one to six weeks after it is inserted in a can so that, immediately before opening the can 1 a superatmospheric pressure of around 2 Bar exists inside the insert 5.

Alternatively, the insert may be charged with a pellet of dry ice or other solid or liquified gas such as liquid nitrogen as it is assembled. By charging the insert immediately before it is placed in a can and the can filled it is possible for the pressure inside the insert to only build up to superatmospheric pressures as the filling operation is completed and results in a generally similar pressure building up inside the can. In this way, the build up of pressure inside the insert 5 is generally matched with the build up in pressure inside the can 1 so that no significant pressure differential exists until the ring-pull 3 on the can 1 is subsequently opened.

Figure 41:
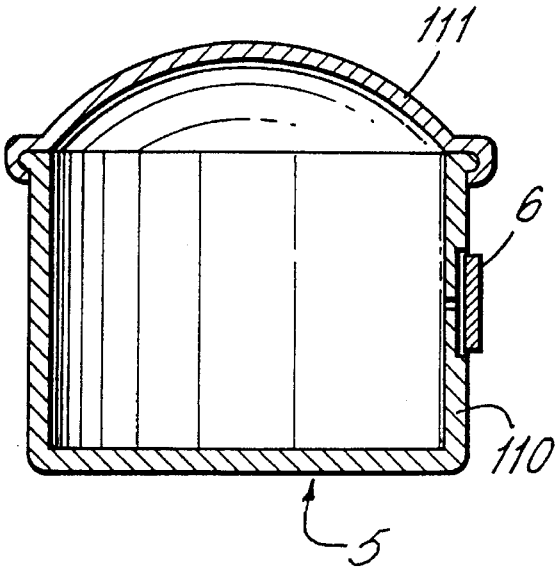
FIG. 41 is a cross-section through an insert prior to its internal pressure being increased.
Figure 42:
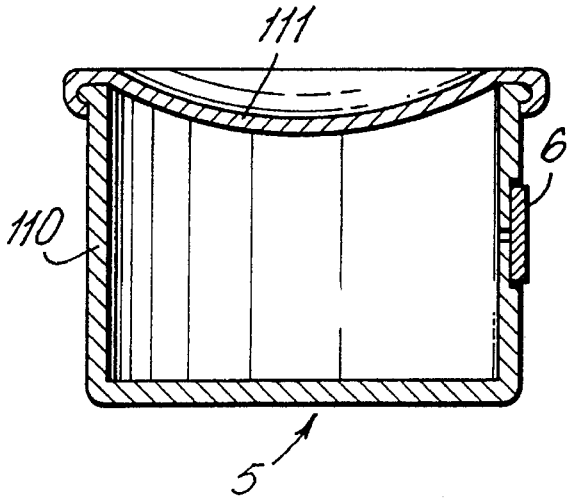
FIG. 42 is a cross-section through the insert shown in FIG. 41 after its internal pressure is increased.

Another way in which the pressure in the insert 5 can be built up after the insert 5 is loaded into a can is for a change in the volume of the insert 5 to occur after it is placed in a can 1. FIG. 41 illustrates a cross-section through a generalised two-part insert 5 with a closure means 6. The two-part insert comprises a base portion 110 and a lid 111. The lid 111 is generally domed when first fitted to the portion 110. The two parts of the insert 5 are preferably assembled in a nitrogen atmosphere at or around atmospheric pressure. The insert is then placed in a can 1 and as the can is filled with beverage 7, dosed with liquid nitrogen, and has its lid 2 sealed to it using conventional can filling machinery the pressure inside the can 1 builds up. Once it is built up to a sufficient extent it everts the lid 111 so that it is forced inwards into the insert 5 as shown in FIG. 42. Thus, the volume enclosed by the insert reduces which, in turn, increases the pressure of gas inside the insert 5. Upon subsequent opening of the can 1 the closure means 6 operates in preference to the reversion of the lid 111.

Figure 43:
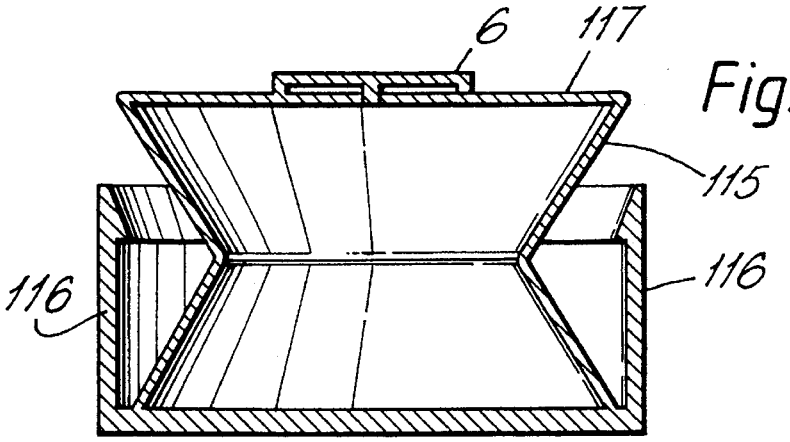
FIG. 43 is a cross-section through another example of insert prior to its internal pressure being increased.
Figure 44:
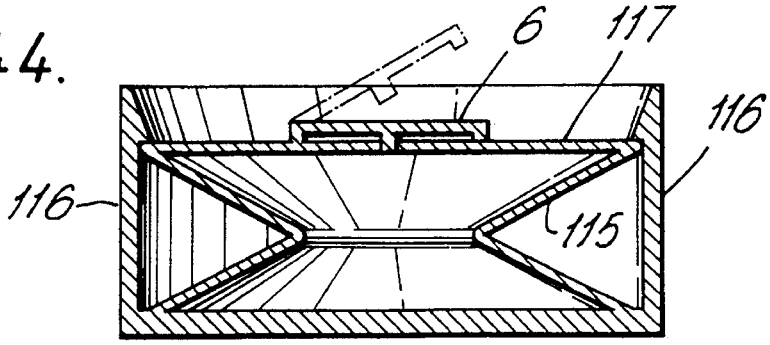
FIG. 44 is a cross-section through the insert shown in FIG. 43 after its internal pressure is increased.

Another example is shown in FIGS. 43 and 44. In this example the insert 5 is formed with side walls 115 that concertina and with spring loaded ratchet arms 116. The insert also include a closure means 6. Again, the insert is filled with nitrogen at atmospheric pressure or slightly above whilst it has the configuration shown in FIG. 43. After it is inserted into a can 1 and the can filled and sealed as the pressure inside the can builds up especially during a subsequent pasteurisation step the insert collapses to reduce its volume so that the pressure inside and outside the insert remains substantially the same. As the insert collapses its top wall 117 forces apart the sprung ratchet arms 116 until the top wall 117 passes their detents whereupon the insert is held by the sprung ratchet arms 116 and retained into its concertinaed configuration.

Figure 45:
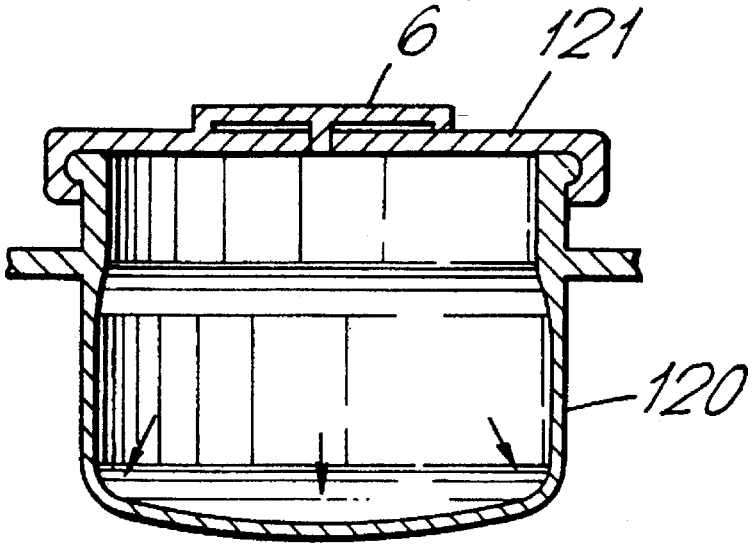
FIG. 45 is a cross-section through a further example of insert before pasteurisation and prior to its internal pressure being increased; and, FIG. 46 is a cross-section through the insert shown in FIG. 45 after pasteurisation and after its internal pressure is increased.
Figure 46:
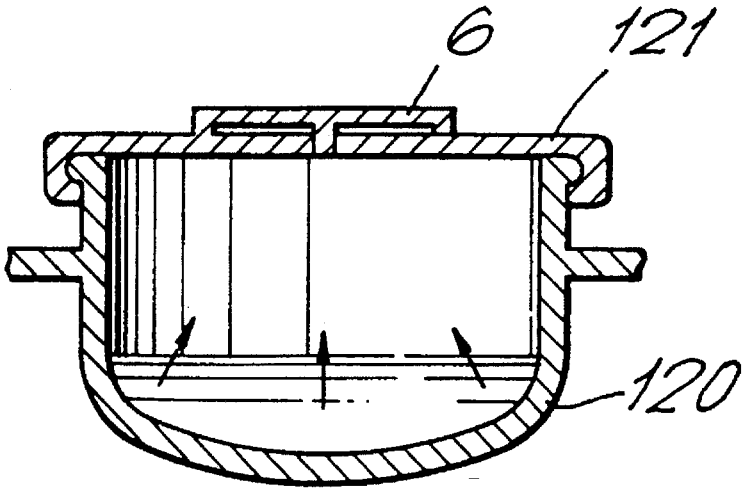

A further example of volume reduction is shown in FIGS. 45 and 46. This example again shows a two-part insert with a main portion 120 and a lid 121 including a closure means 6. The main portion 120 is made from stretch blown PET and has a predetermined volume. The two-parts of the insert 5 are assembled in a nitrogen atmosphere at substantially atmospheric pressure. The insert 5 is again placed inside a can 1, the can filled and sealed. During pasteurisation the can and the beverage it contains is heated to a temperature of around 60° C. for a period of around 20 minutes. During this a pressure of up to 4 Bar builds up inside the can 1. Upon heating the main body portion 120 of the insert to this temperature it tends to shrink to return to the shape that it was before it was blown. This shrinking is encouraged by the differential pressure between that subsisting in the inside of the insert 5 and that subsisting inside the can 1 with the result that there is a considerable volume decrease of the insert 5 during the pasteurisation process. As the can 1 and its contents cool the insert 5 remains at its new smaller volume and contains a superatmospheric pressure substantially the same as that consisting inside the can 1.

What is claimed is:

1. A sealed container (1) including a beverage (7) at a first superatmospheric pressure and a discrete insert (5) having a hollow chamber defined solely by said insert, said hollow chamber containing a non-oxidizing gas under a second superatmospheric pressure and containing substantially no oxidizing gas; said insert (5) further including means (6) normally sealing the hollow chamber from the beverage and being responsive to opening of the container (1) to provide communication between the inside of the insert (5) and the beverage (7) so that on opening the container (1), the means opens to inject gas from the insert into the beverage in the container to cause shearing of the beverage in the container and liberation of small bubbles throughout the contents of said container.

2. A container according to claim 1, in which the means (6) has the form of a pressure responsive valve which, when exposed to the pressure difference subsisting between the gas inside the insert (5) and the atmospheric pressure subsisting in the container (1) after opening, opens to jet gas into the beverage (7) in the body of the container (1).

3. A container according to claim 2, in which the valve comprises a seating (83) surrounding the inside of an orifice (82) and a valve closure member (84, 85) which seats against and forms a seal with the seating, the insert (5) being formed of resilient material and including two opposed faces (81, 86) with the orifice (82) and seating (83) formed on one face (81) and the valve closure member (84, 85) attached to the inside of the other face (86) and extending to the seating (83) on the inside of the one face (81).

4. A container according to claim 2, in which the pressure responsive valve includes a cap which moves in response to a pressure differential being established between the inside and outside of the insert (5) upon opening of the container to expose an orifice through which gas from inside the insert (5) is jetted into the beverage (7) in the container (1).

5. A container according to claim 2, 3 or 4, in which the pressure responsive valve is arranged so that before the insert (5) is placed into the container (1) it resists a substantial pressure difference but, after having been loaded into the container and the container having been filled, sealed and pasteurised has a very much lower pressure differential threshold.

6. A container according to claim 5, in which a closure member or cap of the pressure responsive valve is initially held closed by a temperature or liquid sensitive adhesive which is broken down after filling the container (1).

7. A container according to claims 2, 3, or 4, in which the insert (5) is wholly, or at least partly, made from a material which is permeable by gas present in the container (1) so that during a period after filling, the permeable nature of the insert allows gas from the container (1) to permeate through its walls until a superatmospheric pressure is built-up inside the container (1).

8. A container according to claims 2, 3, or 4, in which the insert (5) is formed in two parts, a main body portion and a separate lid.

9. A method of filling a container (1) comprising a beverage (7) at a first superatmospheric pressure and a discrete insert (5) having a hollow chamber defined solely by said insert, said hollow chamber containing a non-oxidizing gas at a second superatmospheric pressure and containing substantially no oxidizing gas, the insert (5) including means (6) including a pressure responsive valve means, said valve means normally sealing the hollow chamber from the beverage and being responsive to opening of the container (1) to provide communication between the inside of the insert 5 and the beverage (7) so that on opening the container (1) the valve means opens to inject gas from the insert into the beverage in the container to cause shearing of the beverage in the container and liberation of small bubbles throughout the contents of the container; the method comprising inserting the insert (5) into the container (1), filling the container with beverage and sealing it in a conventional filling machine, subjecting the filled container to a subsequent pasteurization process in which the container is heated, thereby changing the state of the insert (5) to reduce the relief pressure of its pressure responsive valve (6) whereby when the container is opened and the insert is subsequently exposed to atmospheric pressure, non-oxidizing gas is injected from the insert (5) via the valve means (6).

10. A method according to claim 9, in which the insert (5) is made of plastics material and in which the change of state that occurs during the pasteurisation process is an inelastic deformation and/or stress relaxation of part of the insert (5).

11. A container according to claim 1, wherein said insert floats in the beverage, and is oriented at all times so that gas is injected into the beverage upon opening of the container.

12. A sealed container (1) including a beverage (7) at a first superatmospheric pressure and a discrete insert (5) having a hollow chamber defined solely by said insert, said hollow chamber containing a non-oxidizing gas under a second superatmospheric pressure and containing substantially no oxidizing gas; said insert (5) further including means (6) normally sealing the hollow chamber from the beverage and being responsive to opening of the container (1) to provide communication between the inside of the insert (5) and the beverage (7) so that on opening the container (1), the means opens to inject gas from the insert into the beverage in the container to cause shearing of the beverage in the container and liberation of small bubbles throughout the contents of said container, the means comprising a pressure responsive valve which is arranged so that, before the insert (5) is placed into the container (1), the insert resists a substantial pressure difference but, after having been filled, sealed, and pasteurized, has a very much lower pressure differential threshold.

13. A method of filling a container (1) comprising a beverage (7) at a first superatmospheric pressure and a discrete insert (5) having a hollow chamber defined solely by said insert, said hollow chamber containing a non-oxidizing gas at a second superatmospheric pressure and containing substantially no oxidizing gas, the insert (5) including means (6) including a pressure responsive valve means, said valve means normally sealing the hollow chamber from the beverage and being responsive to opening of the container (1) to provide communication between the inside of the insert (5) and the beverage (7) so that on opening the container (1) the valve means opens to inject gas from the insert into the beverage in the container to cause shearing of the beverage in the container and liberation of small bubbles throughout the contents of the container; the method comprising inserting the insert (5) into the container (1), filling the container with beverage and sealing it in a conventional filling machine, subjecting the filled container to a subsequent pasteurization process in which the container is heated, thereby changing the state of the insert (5) to reduce the relief pressure of its pressure responsive valve (6), the change of state of the insert being one of an inelastic deformation or a stress relaxation on the part of the insert, whereby when the container is opened and the insert is subsequently exposed to atmospheric pressure, non-oxidizing gas is injected from the insert (5) via the valve means (6).

14. A sealed container (1) comprising a beverage (7) at a first superatmospheric pressure and a discrete insert (5) having a hollow chamber defined solely by said insert, said hollow chamber containing a non-oxidizing gas at a second superatmospheric pressure and containing substantially no oxidizing gas, the insert (5) being arranged to reduce its internal volume after sealing the container (1), the insert (5) including means (6) normally sealing the hollow chamber from the beverage and being responsive to opening of the container (1) to provide communication between the inside of the insert (5) and the beverage (7) so that on opening the container (1) the valve means opens to inject gas from the insert into the beverage in the container to cause shearing of the beverage in the container and liberation of small bubbles throughout the contents of the container.

* * * * *

UNITED STATES PATENT AND TRADEMARK OFFICE

CERTIFICATE OF CORRECTION

PATENT NO. : 5,620,725
DATED : April 15, 1997
INVENTOR(S) : Jamieson et al.

It is certified that error(s) appears in the above-identified patent and that said Letters Patent is hereby corrected as shown below:

On the title page, insert the following information:

[22] PCT Filed: Nov. 22, 1990

[86] PCT No.: PCT/GB90/01806
§ 371 Date: July 22, 1993
§ 102(e) Date: July 22, 1993

[87] PCT Pub. No.: WO 91/07326
PCT Pub. Date: May 30, 1991

Signed and Sealed this

Ninth Day of September, 1997

*Attest:*

Bruce Lehman

BRUCE LEHMAN

*Attesting Officer*

*Commissioner of Patents and Trademarks*